US011423733B2

(12) United States Patent
Shigeta

(10) Patent No.: US 11,423,733 B2
(45) Date of Patent: Aug. 23, 2022

(54) CARD GAME MONITORING SYSTEM

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

(21) Appl. No.: 15/894,090

(22) Filed: Feb. 12, 2018

(65) Prior Publication Data

US 2018/0174395 A1 Jun. 21, 2018

Related U.S. Application Data

(63) Continuation of application No. 15/112,038, filed as application No. PCT/JP2015/000171 on Jan. 16, 2015, now Pat. No. 11,145,158.

(30) Foreign Application Priority Data

Jan. 17, 2014 (AU) ..... 2014200314

(51) Int. Cl.
*G07F 17/32* (2006.01)

(52) U.S. Cl.
CPC ..... *G07F 17/3206* (2013.01); *G07F 17/322* (2013.01); *G07F 17/3237* (2013.01);
(Continued)

(58) Field of Classification Search
CPC ..... G07F 17/3206; G07F 17/322; G07F 17/3248; G07F 17/3276; G07F 17/3293
(Continued)

(56) References Cited

U.S. PATENT DOCUMENTS 4,531,187 A 7/1985 Uhland
5,781,647 A * 7/1998 Fishbine ..... G07D 9/04 235/375

(Continued)

FOREIGN PATENT DOCUMENTS

AU 2012201094 A1 3/2012
CA 2543251 A1 10/2000

(Continued)

OTHER PUBLICATIONS

International Application No. PCT/JP2015/000171, International Search Report and Written Opinion dated Mar. 27, 2015.

(Continued)

*Primary Examiner* — Omkar A Deodhar
(74) *Attorney, Agent, or Firm* — Norton Rose Fulbright US LLP

(57) ABSTRACT

The card game monitoring system has: a game table on which bettors put wagers on betting areas; and a card shooter apparatus has a card reading unit to read and record the number (rank) and suit of the cards; and a control unit to determine a winning hand according to a table game rules based on information of numbers (ranks) and suits of the cards sequentially read by the card reading unit; a monitor video camera system to capture positions of cards and to identify wagers on each betting area at the game table; the control unit has further processing function to check whether wagers with payoff move to a pool of the winner of the bettors determined by the card shooter apparatus at the end of each game.

19 Claims, 2 Drawing Sheets

(52) U.S. Cl.
CPC ..... *G07F 17/3241* (2013.01); *G07F 17/3248* (2013.01); *G07F 17/3276* (2013.01); *G07F 17/3293* (2013.01)

(58) Field of Classification Search
USPC ..... 463/25
See application file for complete search history.

(56) References Cited

U.S. PATENT DOCUMENTS 6,093,103 A 7/2000 McCrea, Jr.
6,117,012 A 9/2000 McCrea, Jr.
6,460,848 B1 10/2002 Soltys et al.
6,514,140 B1 * 2/2003 Storch ..... G07F 1/06 463/13
6,582,301 B2 6/2003 Hill
6,848,994 B1 * 2/2005 Knust ..... G06Q 20/04 273/148 R
6,908,385 B2 6/2005 Green
8,337,296 B2 12/2012 Grauzer et al.
2002/0042298 A1 * 4/2002 Soltys ..... G07F 17/3251 463/29
2002/0045476 A1 4/2002 Poole et al.
2002/0045479 A1 * 4/2002 Soltys ..... G06Q 10/0639 463/29
2002/0089120 A1 * 7/2002 Miller ..... A63F 3/00157 273/274
2002/0123376 A1 9/2002 Walker et al.
2002/0155869 A1 * 10/2002 Soltys ..... A63F 1/18 463/11
2003/0064798 A1 4/2003 Grauzer et al.
2003/0087696 A1 5/2003 Soltys et al.
2003/0195025 A1 * 10/2003 Hill ..... A63F 1/18 463/11
2003/0232651 A1 * 12/2003 Huard ..... G07F 17/32 463/42
2005/0012270 A1 1/2005 Schubert et al.
2005/0026680 A1 2/2005 Gururajan
2005/0051965 A1 * 3/2005 Gururajan ..... A63F 1/14 273/292
2005/0062226 A1 3/2005 Schbert et al.
2005/0137005 A1 6/2005 Soltys et al.
2005/0148391 A1 7/2005 Tain
2005/0258597 A1 11/2005 Soltys et al.
2005/0272501 A1 * 12/2005 Tran ..... G07F 17/3241 463/29
2005/0288086 A1 * 12/2005 Schubert ..... G07F 17/32 463/11
2006/0027970 A1 2/2006 Kyrychenko
2006/0063577 A1 3/2006 Downs, III et al.
2006/0160608 A1 7/2006 Hill et al.
2006/0177109 A1 * 8/2006 Storch ..... A63F 1/00 382/118
2006/0183540 A1 * 8/2006 Grauzer ..... G07F 17/32 463/29
2006/0199649 A1 9/2006 Soltys et al.
2006/0202422 A1 9/2006 Bahar
2006/0217199 A1 * 9/2006 Adcox ..... G07F 17/3223 463/40
2006/0252521 A1 * 11/2006 Gururajan ..... A63F 1/00 463/29
2007/0015583 A1 * 1/2007 Tran ..... G07F 17/3288 463/40
2007/0049369 A1 3/2007 Kuhn et al.
2007/0111773 A1 5/2007 Gururajan et al.
2007/0117604 A1 5/2007 Hill
2007/0178955 A1 * 8/2007 Mills ..... A63F 1/00 463/13
2008/0113783 A1 * 5/2008 Czyzewski ..... A63F 3/00157 463/29
2008/0143048 A1 6/2008 Shigeta
2008/0180250 A1 * 7/2008 Steil ..... A63F 1/06 340/572.1
2008/0303210 A1 12/2008 Grauzer et al.
2009/0075725 A1 3/2009 Koyama
2009/0104961 A1 4/2009 Hamada et al.
2009/0121434 A1 5/2009 Baerlocher et al.
2009/0131151 A1 * 5/2009 Harris ..... G07F 17/32 463/22
2009/0140492 A1 6/2009 Yoseloff et al.
2009/0143141 A1 6/2009 Wells et al.
2009/0176546 A1 7/2009 Kyrychenko
2009/0191933 A1 * 7/2009 French ..... G07F 17/32 463/12
2009/0233699 A1 * 9/2009 Koyama ..... G07F 17/3232 463/25
2009/0273141 A1 11/2009 Bahar
2010/0016050 A1 1/2010 Snow et al.
2010/0109244 A1 5/2010 Low
2010/0207324 A1 8/2010 Soltys et al.
2010/0244382 A1 9/2010 Snow
2011/0052049 A1 * 3/2011 Rajaraman ..... G06T 7/12 382/165
2011/0079959 A1 * 4/2011 Hartley ..... G07F 17/32 273/292
2011/0127722 A1 * 6/2011 Emori ..... G07F 17/32 273/274
2011/0227703 A1 9/2011 Kotab
2012/0080845 A1 * 4/2012 Emori ..... G07F 17/3237 273/309
2012/0231866 A1 9/2012 Witty et al.
2012/0252564 A1 * 10/2012 Moore ..... G07F 17/322 463/25
2013/0109455 A1 5/2013 Grauzer et al.
2013/0307215 A1 11/2013 Shigeta
2014/0094239 A1 * 4/2014 Grauzer ..... A63F 1/12 463/13
2015/0087417 A1 * 3/2015 George ..... G07F 17/3237 463/31
2015/0375096 A1 * 12/2015 Jackson ..... A63F 1/14 463/11

FOREIGN PATENT DOCUMENTS

CN 101687112 A 3/2010
CN 102125756 A 7/2011
CN 102892472 A 1/2013
CN 103418128 A 12/2013
EP 2545967 A2 1/2013
EP 2613298 A1 7/2013
JP 2012075781 A 4/2012
MO I001207 A 11/2013
TW 201200214 A 1/2012
WO 98/33566 A1 8/1998
WO 01/91866 A1 12/2001
WO 2005/025701 A2 3/2005

OTHER PUBLICATIONS

Written Opinion of the Intellectual Property Office of Singapore dated Jul. 10, 2017 issued in corresponding Singapore Application No. 11201605347T.
Search Report of the Intellectual Property Office of Singapore dated Jul. 7, 2017 completed in corresponding Singapore Application No. 11201605347T.
Office Action dated Dec. 1, 2017 for EP Application 15701853.2.
Office Action dated Jun. 29, 2017 for New Zealand Application 721845.
Office Action dated Sep. 8, 2017 for parent application, U.S. Appl. No. 15/112,038.
European Search Report dated Sep. 25, 2018 for EPApplication 18187764.8.
Office Action dated Jul. 13, 2018 for U.S. Appl. No. 15/112,038.
U.S. Office Action dated Nov. 20, 2018 for U.S. Appl. No. 15/998,000.
U.S. Office Action dated Jan. 10, 2019 for U.S. Appl. No. 15/112,038.
Singaporean Office Action dated May 13, 2019 for SG Application No. 10201801579R.
Chinese Office Action dated Jan. 3, 2020 issued in corresponding CN Application No. 201810096721.5.

(56) References Cited

OTHER PUBLICATIONS

Examination Report for AU Application No. 2018203865 dated Aug. 14, 2019.
Final Action for U.S. Appl. No. 16/000,056 dated Aug. 20, 2019.
Search Report & Written Opinion for SG Application No. 10201804982S dated Aug. 21, 2019.
Final Action for U.S. Appl. No. 15/998,000 dated Sep. 9, 2019.
Office Action for U.S. Appl. No. 15/112,038 dated Sep. 20, 2019.
U.S. Office Action dated Apr. 17, 2020 issued in corresponding U.S. Appl. No. 15/998,000.
U.S. Notice of Allowance dated Jan. 13, 2021 issued in U.S. Appl. No. 16/000,056.
U.S. Final Office Action dated Nov. 10, 2020 issued in U.S. Appl. No. 16/150,378.
Chinese Office Action dated Jun. 9, 2021 issued in CN Application No. 202010076775.2.
Chinese Office Action dated Jun. 9, 2021 issued in CN Application No. 202010076776.7.
Chinese Office Action dated Jun. 23, 2021 issued in CN Application No. 202010076770.X.
U.S. Office Action dated Jun. 10, 2021 issued in U.S. Appl. No. 15/998,000.
U.S. Notice of Allowance dated Mar. 22, 2022 issued in U.S. Appl. No. 15/998,000.
JP Decision of Dismissal of Amendment dated Apr. 12, 2022 issued in JP Application No. 2020-178113.
Chinese Office Action dated Mar. 21, 2022 issued in CN Application No. 201810096721.5.

* cited by examiner

CARD GAME MONITORING SYSTEM

CROSS REFERENCE TO RELATED APPLICATIONS

This application is a continuation from U.S. application Ser. No. 15/112,038 filed Jul. 15, 2016, which was a 35 U.S.C. § 371 national phase application from International Application No. PCT/JP2015/000171 filed Jan. 16, 2015, which claims priority to AU Application No. 2014200314 filed Jan. 17, 2014, each of which is hereby incorporated by reference.

TECHNICAL FIELD

The present invention relates to a table game monitoring system for a table game using playing cards from a shoe having multiple decks that have been shuffled together prior to the beginning of play in which bettors make wagers on betting areas of a game table in front of the bettors. This table game monitoring system monitors whether or not wagers of winning bettor(s) move to appropriate area of the winner(s).

BACKGROUND ART

Baccarat and Black Jack are of the many live table games played in casinos or gaming establishments. These games use a standard deck of 52 playing cards and are usually dealt from a shoe having multiple decks (6 to 9 or 10 decks) that have been shuffled together prior to the beginning of play. When operating people (hereinafter "the dealer") in casinos deliver playing cards to a game table for plays in such games, any loss of cards or exchange of cards between bettors, etc. should not occur, and also wagers with payoffs must correctly go to the winners of the bettors after each game has ended.

To assure fair games by preventing such loss or exchanges during games, the game tables in casinos should be administrated so that games at tables are played properly (i.e. there is no exchange of cards or any other accidental or fraudulent acts etc.) and wagers are correctly paid off to the winners. A system to monitor the game tables by camera is known and is disclosed in Patent Literature 1: (U.S. Pat. No. 6,582,301). This known system only monitors the table game and records whole games for later analysis if it is believed that some inappropriate act has occurred.

CITATION LIST

U.S. Pat. No. 6,582,301B

SUMMARY OF INVENTION

The present invention provides a real-time monitoring of the table game and enables the casino to stop an ongoing game immediately when something unexpected happens by administrating the whole game from the start to the end of the game.

The present invention has been made in view of the above problem, and aims to provide a table game monitoring system with which it is possible to allow a casino to stop an ongoing game immediately when something unexpected happens by administrating the whole game from the start to the end of the game and during payoffs.

To solve the above conventional problems, the present invention provides the card game monitoring system having:

a game table on which bettors make wagers on betting areas, a card shooter apparatus that is put on the game table and has a card reading unit that reads the number (rank) of the card and having a control unit to determine a winning hand according to a table game rules based on information of numbers of the cards sequentially read by the card reading unit and a monitor video camera system to capture positions of the card delivered from the card shooter apparatus to bettors and identify wagers on each betting area at the game table, the control unit has a processing function using the information of the monitor video camera system to determine: 1) head-count of the bettors playing each game by identifying the wagers on each betting area or cards delivered to bettors, 2) whether or not each bettor gets more than two cards from the card shooter apparatus, 3) each hand of the bettors and the dealer according to the information read by the card shooter apparatus using the information of head-count of the bettors according to the game rule, and 4) the winner(s) having the winning hand(s) in the game according to the game rule based on the information of the each hand of the bettors and the dealer, wherein the monitor video camera system further reads movements of wagers on the game table, and the control unit having further processing function to check whether wagers with payoffs move to the winner of the bettor determined by the card shooter apparatus at the end of each game.

In the card game monitoring system, the control unit has further processing function to identify ranks of playing cards on the game table delivered by a dealer and to check and report whether ranks of cards are the same as the ones determined by the card shooter apparatus.

DESCRIPTION OF EMBODIMENTS

Figure 1:
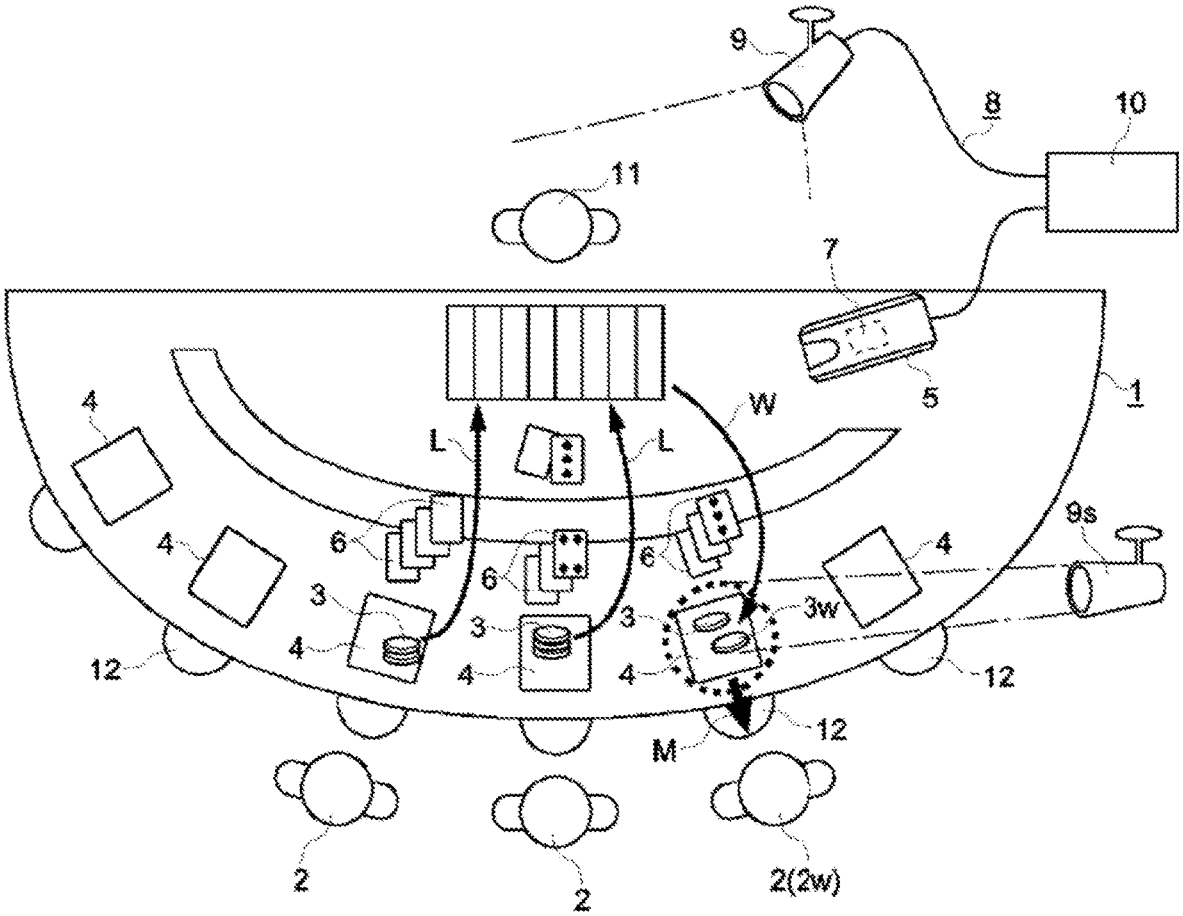
FIG. 1 is a diagram schematically showing the entirety of a table game system according to an embodiment 1 of the present invention.

Embodiment 1 of the present invention will be described with reference to the attached drawings. Embodiment 1 of the present invention provides a card game monitoring system for playing Black Jack. In FIG. 1, the card game monitoring system has: a game table 1 on which bettors 2 make wagers by putting wagers 3 on betting areas 4; a card shooter apparatus that is put on the game table 1 and has a card reading unit that reads the number (rank) and suit of the cards 6 and having a control unit 7 to determine a winning hand according to a table game rule based on information of numbers (ranks) of the cards sequentially read by the card reading unit 5.

A monitor video camera system 8 which has several cameras 9 is set above each game table 1 to capture the positions of cards 6 delivered from the card shooter apparatus 5 to bettors 2. The monitor video camera system 8 identifies wagers 3 on each betting area 4 at the game table 1, the control unit 10 has a processing function using the information of the monitor video cameras 9 to determine the following: 1) head-count of the bettors playing on each game by identifying the positions of wagers on each betting area or cards delivered to each bettor 2 (three persons (heads) shown in FIG. 1), 2) number of cards delivered for each bettor 2 by dealer 11 from the card shooter apparatus 5 (whether or not each bettor 2 gets more than two cards).

The control unit 10 has further processing function using information from the monitor video cameras 9 to determine each hand of the bettors 2 and the dealer 11 according to the information read by the card shooter apparatus 5 using the information of the results of head-counting of the bettors 2 and according to the game rules installed in the control unit 7 of the card shooter apparatus 5. Then the control unit 7 will determine the winner W having the winning hand on the game based on the information of the hands of the bettors 2 and the dealer 11.

Wherein the card shooter apparatus 5 knows directions of each card (who gets each card read by the card shooter apparatus 5 through the monitor video camera system 8) and then the card shooter apparatus 5 (the control unit 7) will figure out by its programs the hands held by the bettors 2 and the dealer 11. The control unit 10 has further a processing function to check whether wagers 3 with payoffs 3W move to a pool 12 of the winner 2W of the bettors 2 determined by the card shooter apparatus 5 at the end of each game (the movement M for the winners and L for loser in FIG. 1).

The monitor video camera system 8 (with the control unit 10) has further processing function that identify ranks of playing cards 6 by analyzing pictures from the monitor video cameras 9 to determine each hand (number) of the bettors 2 on the game table delivered by a dealer 11 and checks whether suits and ranks of cards 6 are the same as the ones read and determined by the card shooter apparatus 5.

The monitor video camera system 8 (the control unit 10) has further processing function that identifies total amounts of wagers 3 by counting chips on each betting area 4 of the bettors 2. Each total amount of wagers 3 are calculated by analyzing pictures from the monitor video cameras 9 of its colors and its height of chips on each betting areas 4. Special video cameras 9*s* for this purpose may be put around the game table 1 to take side views of the chips of wagers 3.

Figure 2:
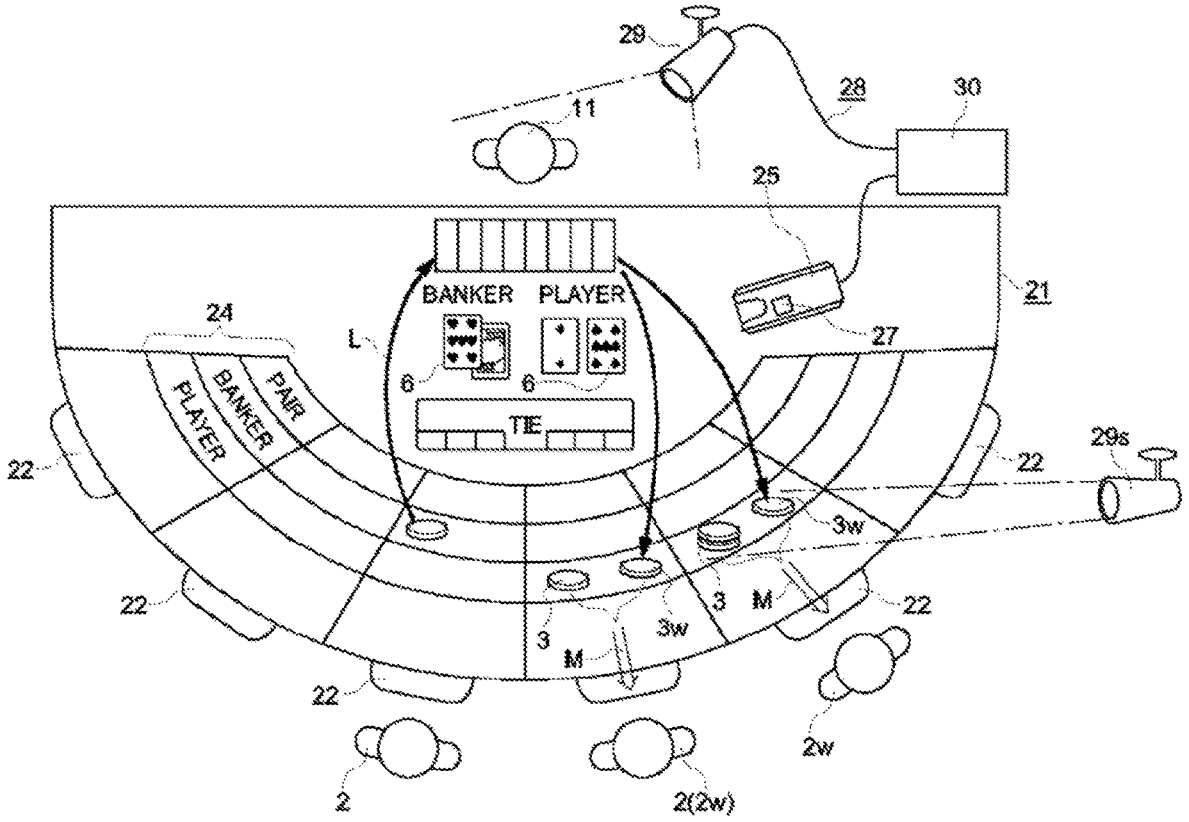
FIG. 2 is a diagram schematically showing the entirety of a table game system according to an embodiment 2 of the present invention.

FIG. 2 shows an example of Embodiment 2 of the present invention. Embodiment 2 of the present invention provides a card game monitoring system for playing game (Baccarat). In FIG. 2, the card game monitoring system has: a game table 21 on which bettors 2 make wagers by putting wagers 3 on betting areas 24; a card shooter apparatus 25 that is put on the game table 21 and has a card reading unit that reads the number (rank) and suit of the cards 6 and having a control unit 27 to determine a winning hand according to a table game rule based on information of numbers (ranks) of the cards 6 sequentially read by the card shooter apparatus 25.

A monitor video camera system 28 reads cards and movements of the wagers 3 on the game table. The control unit 27 of the card shooter apparatus 25 has processing functions to determine whether the winning hand is the Banker or the Player based on information of numbers (ranks) of the cards read by the a card shooter apparatus 25 and Baccarat game rule in the control unit 27. A control unit 30 of the card game monitoring system having processing function to check whether wagers 3 with payoffs 3W move to a pool 22 of the winners 2W of the bettors 2 after each game has ended.

Wherein the card shooter apparatus 25 knows that place (Banker or Player) to which each card is delivered according to the game rule of Baccarat and then the card shooter apparatus 25 (with the control unit 27) will calculate each hand of Banker and Player. In this way the card shooter apparatus 25 determines whether a winning hand is the Banker or the Player. The control unit 30 has a further processing function to check whether wagers 3 with payoffs 3W move to a pool 22 of the winner 2W of the bettors 2 determined by the card shooter apparatus 25 at the end of each game (the movement M for the winners and L for loser movement M in FIG. 2).

The monitor video camera system 28 (with the control unit 30) has further processing function that identify ranks of playing cards 6 on the game table 21 delivered by a dealer 11 by analyzing pictures obtained from the monitor video cameras 29. This card game monitoring system checks whether suits and ranks of cards 6 are the same as the ones read and determined by the card shooter apparatus 25 and reports to an administration section of the casino the results of whether the suits and ranks of cards 6 are the same as those delivered and read by the card shooter apparatus 25.

The monitor video camera system 28 (the control unit 30) has further processing function that identify total amounts of wagers 3 by counting chips on each betting area 24 of the bettors 2. Each total amount of wagers 3 is calculated by analyzing pictures from the monitor video cameras 29 of its colors and its height of chips on each betting areas 24. Special video cameras 29*s* for this purpose may be put around the game table 21 to take side views of the chips of wagers 3.

In both examples of Embodiment 1 and 2 the monitor video camera system 8 and 28 can identify positions of wagers 3, the total amount of wagers 3 of its colors and its height of chips on each betting areas 4 and 24 by analyzing pictures taken by the video cameras 9, 9*s*, 29 and 29*s* using CCD and through known technology of vision analysis. The monitor video camera system 8 and 28 can also identify positions of cards 3 and analyze the faces of cards showing in betting.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Annex 1

The card game monitoring system mentioned above, the card shooter apparatus has further determination function of the card games when each game starts and ends according to the rules of Baccarat or Black Jack with monitoring video camera system.

Annex 2

The card game monitoring system mentioned above, the control unit has further processing function to check whether wagers do not move from the original betting position to the other area during the each game starts and ends (during each game).

Annex 3

The card game monitoring system mentioned above, the control unit has a determination function to determine when the betting starts before the start of each game (the betting start indicates the time the first bet is put on the betting area).

Annex 4

The card game monitoring system mentioned above, the control unit has a determination function to determine when the betting ends before the start of each game (the betting end indicates the time the first card is delivered from the card shooter apparatus). Also the control unit has a processing function using the information from the monitor video camera system to determine the movement of the dealer's hand representing the end of betting called "No more bet".

Annex 5

The card game monitoring system mentioned above, the control unit has a determination function to determine when the payoff has completed after the end of each game.

Annex 6

The card game monitoring system mentioned above, the control unit has a transmitting function to transmit the information of the monitor video camera to a backyard in casino.

Annex 7

The card game monitoring system mentioned above, the control unit has a determination function to determine an error, and the card game monitoring system further has an output means to output an error signal by displaying and/or alarming in the card shooter apparatus and/or the related system components incorporated in the card game monitoring system as a result of the determination of the error. The error mentioned above includes at least one of the following items: 1) The ranks of playing cards identified by the card game monitoring system on the game table delivered by the dealer are not same as the ones determined by the card shooter apparatus; 2) Wagers have moved from the original betting position to other areas during each game; and 3) Wagers with payoffs have not moved to the winners of the bettors at the end of each game.

Annex 8

The card game monitoring system mentioned above, the control unit has a determination function to identify a cut card delivered from the card shooter apparatus.

The invention claimed is:

1. A card game monitoring system for playing a game, the card game monitoring system comprising:

a control system including one or more control units, the one or more control units including a control unit corresponding to a camera system, the control unit configured to:

receive, from the camera system, image information of one or more wagers on betting areas of a gaming table for the game;

determine a start of betting corresponding to when a first bet is placed on any of the betting areas;

determine, based on the image information of the one or more wagers, at least one stack of one or more chips and a position of the one or more chips used in the game;

determine an end of betting corresponding to when a first card of the game is dealt from an electronic dealing shoe associated with the gaming table; and determine each hand of a plurality of hands of the game.

2. The card game monitoring system according to claim 1, further comprising the camera system, the camera system including one or more cameras configured to capture one or more images of the gaming table, generate the image information of the one or more wagers based on the captured one or more images of the gaming table, and send the image information of the one or more wagers to the control unit.

3. The card game monitoring system according to claim 1, wherein the control unit is further configured to determine a time when a payoff is complete.

4. The card game monitoring system according to claim 1, wherein the control unit is configured to determine, based on a start of the game and an end of the game, a duration of the game, a number of games played during a particular time period, or a combination thereof.

5. The card game monitoring system according to claim 1, wherein the control unit is further configured to:

determine a duration of a the game from an end of a previous game to a start of a next game; and determine a number of games played during a particular time period.

6. The card game monitoring system according to claim 1, wherein the control unit is further configured to:

send the determined each hand of the plurality of hands of the game to a controller of an electronic dealing shoe; and receive an indication of one or more winners identified by the controller of the electronic dealing shoe.

7. The card game monitoring system according to claim 6, wherein the control unit is further configured to, after the game has ended and based on the indication of the one or more winners identified by the controller, determine whether those of the wagers with payoffs are received by each of the one or more winners and whether those of the wagers without payoffs are received by a dealer.

8. The card game monitoring system according to claim 1, wherein the betting start is determined based on the image information.

9. The card game monitoring system according to claim 1, wherein the control unit is further configured to:

determine the start of betting, determine a betting start time corresponding to when the first bet is placed; and determine the end of betting, determine a betting end time corresponding to when the first card of the game is dealt from the electronic dealing shoe.

10. The card game monitoring system according to claim 1, wherein the control unit is further configured to:

determine a start of the game corresponding to when the game starts; and determine an end of the game corresponding to when the game ends.

11. The card game monitoring system according to claim 1, wherein the control unit is further configured to:

determine the start of the game, determine a start time corresponding to when the game starts; and determine the end of the game, determine an end time corresponding to when the game ends.

12. A card game monitoring system for playing a game, the card game monitoring system comprising:

a control system including one or more control units, the one or more control units including a control unit corresponding to a camera system, the control unit configured to:

receive, from the camera system, image information of one or more wagers on betting areas of a gaming table for the game;

determine a start of the game corresponding to when the game starts;

determine, based on the image information of the one or more wagers, at least one stack of one or more chips and a position of the one or more chips used in the game;

determine each hand of a plurality of hands of the game; and determine an end of the game corresponding to when the game ends.

13. The card game monitoring system according to claim 12, wherein the control unit is further configured to:

to determine the start of the game, determine a start time corresponding to when the game starts; and to determine the end of the game, determine an end time corresponding to when the game ends.

14. The card game monitoring system according to claim 12, wherein the control unit is further configured to:

determine a betting start time corresponding to when a first bet is placed on any of the betting areas; and determine a betting end time corresponding to when a first card of the game is dealt from an electronic dealing shoe associated with the gaming table.

15. The card game monitoring system according to claim 12, further comprising the camera system, the camera system including one or more cameras configured to capture one or more images of the gaming table, generate the image information of the one or more wagers based on the captured one or more images of the gaming table, and send the image information of the one or more wagers to the control unit.

16. The card game monitoring system according to claim 12, wherein the control unit is further configured to determine a time when a payoff is complete.

17. The card game monitoring system according to claim 13, wherein the control unit is configured to determine, based on the start of the game and the end of the game, a duration of the game, a number of games played during a particular time period, or a combination thereof.

18. The card game monitoring system according to claim 12, wherein the control unit is further configured to:

determine a duration of a the game from an end of a previous game to a start of a next game; and determine a number of games played during a particular time period.

19. The card game monitoring system according to claim 12, wherein the control unit is further configured to:

send the determined each hand of the plurality of hands of the game to a controller of an electronic dealing shoe; and receive an indication of one or more winners identified by the controller of the electronic dealing shoe.

* * * * *